US006660688B2

(12) United States Patent
Yamada et al.

(10) Patent No.: US 6,660,688 B2
(45) Date of Patent: Dec. 9, 2003

(54) THERMOSENSITIVE RECORDING MEDIUM

(75) Inventors: Hiroshi Yamada, Numazu (JP); Tomohisa Kakuda, Numazu (JP); Takeshi Kajikawa, Shizuoka-ken (JP)

(73) Assignee: Ricoh Company Ltd., Tokyo (JP)

( * ) Notice: Subject to any disclaimer, the term of this patent is extended or adjusted under 35 U.S.C. 154(b) by 82 days.

(21) Appl. No.: 09/867,557

(22) Filed: May 30, 2001

(65) Prior Publication Data

US 2002/0010095 A1 Jan. 24, 2002

(30) Foreign Application Priority Data

| | | |
|---|---|---|
| May 31, 2000 | (JP) | 2000-161731 |
| Jun. 8, 2000 | (JP) | 2000-172416 |
| Aug. 4, 2000 | (JP) | 2000-237440 |

(51) Int. Cl.[7] ..... B41M 5/30
(52) U.S. Cl. ..... 503/209; 503/208; 503/216
(58) Field of Search ..... 503/208, 209, 503/216, 226

(56) References Cited

U.S. PATENT DOCUMENTS

| | | | | |
|---|---|---|---|---|
| 4,888,321 | A | 12/1989 | Kawakami et al. | 503/208 |
| 5,827,590 | A | 10/1998 | Morita et al. | 428/40.1 |
| 5,919,729 | A | 7/1999 | Mori et al. | 503/200 |
| 5,972,836 | A | 10/1999 | Morita et al. | 503/207 |
| 6,043,190 | A | 3/2000 | Ichikawa et al. | 503/200 |

FOREIGN PATENT DOCUMENTS

| | | |
|---|---|---|
| JP | 61233584 | 10/1986 |
| JP | 61246088 | 11/1986 |
| WO | 9951444 | 10/1999 |
| WO | 00 66364 | 11/2000 |

OTHER PUBLICATIONS

Patent Abstracts of Japan, vol. 011, No. 078 (M–570), Mar. 10, 1987, abstract of JP 61 233584A, 10/86, Japan.
Communication Pursuant to Article 96(2) EPC in European Patent Application No. 01 112 871.7—1251, Dated Apr. 24, 2002.
U.S. patent application Ser. No. 09/557,033, Ichikawa et al., filed Apr. 21, 2000.

*Primary Examiner*—B. Hamilton Hess
(74) *Attorney, Agent, or Firm*—Cooper & Dunham LLP

(57) ABSTRACT

A thermosensitive recording medium including; a support; and a thermosensitive recording layer formed overlying the support and including a leuco dye, a color developer and a sensitizer, wherein the color developer includes a compound selected from the group consisting of compounds having one of the following formulae (1), (2) and (3):

(1)

(2)

and (3)

methylenebis(2-naphthol); and condensation products of a polyhydric alcohol component including a polyhydric alcohol having three or more hydroxyl groups with a carboxylic acid component including a 4-hydroxybenzoic acid compound having the following formula (4):

(4)

wherein m is 0 or an integer of from 1 to 2, and wherein the sensitizer includes 4-acetylbiphenyl.

17 Claims, 3 Drawing Sheets

THERMOSENSITIVE RECORDING MEDIUM

BACKGROUND OF THE INVENTION

1. Field of the Invention

The present invention relates to a thermosensitive recording medium.

2. Discussion of the Related Art

Thermosensitive recording media typically have a structure in which a thermosensitive coloring layer (i.e., a thermosensitive recording layer) which colors upon application of heat thereto is formed on a support such as paper, synthetic paper and resin films. Thermal printers having printing head such as thermal printheads are typically used for coloring the recording media (i.e., for recording images in the recording media).

Such a thermal recording method has the following advantages against the other recording methods:

(1) recording can be performed at a relatively high speed using a simple image forming apparatus because development and fixation processes are not needed in the image forming apparatus; and (2) the costs of the recording media are relatively low.

Therefore, thermosensitive recording media have been used for various applications as follows:

(1) POS (point of sales) labels for foods, boxed lunches, dairy dishes, etc.;

(2) Copy papers;

(3) Receiving papers for facsimile machines; and (4) Tickets and receipts.

Among these applications, the application for POS labels are remarkably expanding. When thermosensitive recording media are used for the labels for hot foods and dairy dishes, a problem which often occurs is that the information recorded in the labels cannot be recognized because of coloring of the background areas of the information printed in the labels.

International Publication No. WO99/51444 discloses a sensitizer such as bis(4-methylbenzyl) oxalate, bis(4-chlorobenzyl) oxalate, acetoacetic o-chloroanilide, diphenylsulfone, stearic acid amide, etc., to improve the thermosensitivity of the resultant thermosensitive recording medium. However, this recording material has drawbacks such that the color density is low, and the thermosensitivity is not satisfactory.

Japanese Laid-Open Patent Publication No. 61-246088 discloses that 4-acetylbiphenyl is useful as a sensitizer for a thermosensitive recording medium. However, even when such a sensitizer is used, the recorded images in the recording medium have unsatisfactory heat resistance. In addition, the background area of the images has also unsatisfactory heat resistance.

Because of these reasons, a need exists for a thermosensitive recording medium having a combination of high thermosensitivity and good heat resistance so as to be used for the applications such as labels for hot foods and dishes.

SUMMARY OF THE INVENTION

Accordingly, an object of the present invention is to provide a thermosensitive recording medium having a combination of high thermosensitivity and good heat resistance so as to be used for the applications such as labels for hot foods and dishes.

To achieve such objects, the present invention contemplates the provision of a thermosensitive recording medium including a thermosensitive recording layer formed overlying a support, where the recording layer includes at lease a leuco dye, a color developer and a sensitizer, wherein the color developer includes a compound selected from the group consisting of methylenebis(2-naphthol), compounds having a formula selected from the group consisting of the following formulae (1) to (3):

(1)

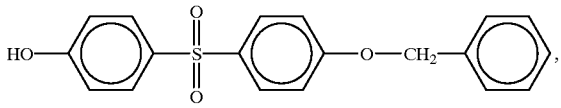

(2)

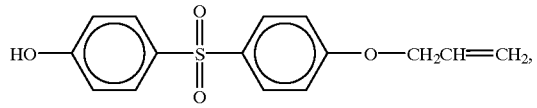

and (3)

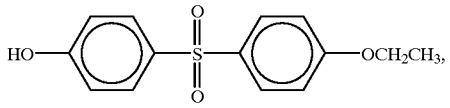

and condensation products of a polyhydric alcohol component including a polyhydric alcohol having three or more hydroxyl groups with a carboxylic acid component including 4-hydroxybenzoic acid compound having the following formula (4):

(4)

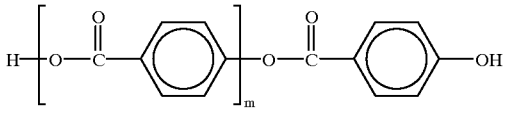

wherein m is 0 or an integer of from 1 to 2, and wherein the sensitizer includes 4-acetylbiphenyl.

The polyhydric alcohol having three or more hydroxyl groups preferably has the following formula (6):

(6)

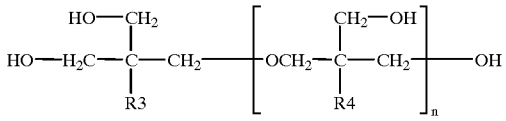

wherein n is 0 or an integer of from 1 to 9; R3 represents a hydroxymethyl group or an alkyl group having 1 to 8 carbon atoms; and each R4 independently represents a hydroxymethyl group or an alkyl group having 1 to 8 carbon atoms (i.e., for n>1, such that there are two or more of R4 present, each R4 may be the same as or different from any other R4).

The leuco dye preferably includes 3-diethylamino-6-ethyl-7-(3-methylanilino)fluoran.

It is preferable that the thermosensitive layer preferably further includes a compound having the following formula (5):

(5)

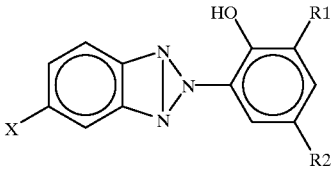

wherein X represents a hydrogen atom or a chlorine atom; and R1 and R2 independently represent a hydrogen atom or an alkyl group having from 1 to 8 carbon atoms except that R1 and R2 are not both a hydrogen atom.

The thermosensitive recording medium may include a protective layer on the thermosensitive recording layer, which preferably includes a compound having formula (5).

In addition, it is preferable that the recording layer further includes at least one of tetrakis(1,2,2,6,6-pentamethyl-4-piperidyl)-1,2,3,4-butanetetracarboxylate and tetrakis(2,2,6,6-tetramethyl-4-piperidyl)-1,2,3,4-butanetetracarboxylate.

Further, the thermosensitive recording medium may include an undercoat layer between the support and the thermosensitive recording layer, which preferably includes hollow particles having a hollow rate not less than 30% and a volume average particle diameter of from 0.4 to 10 $\mu$m.

These and other objects, features and advantages of the present invention will become apparent upon consideration of the following description of the preferred embodiments of the present invention taken in conjunction with the accompanying drawings.

DESCRIPTION OF THE PREFERRED EMBODIMENTS

Figure 1:
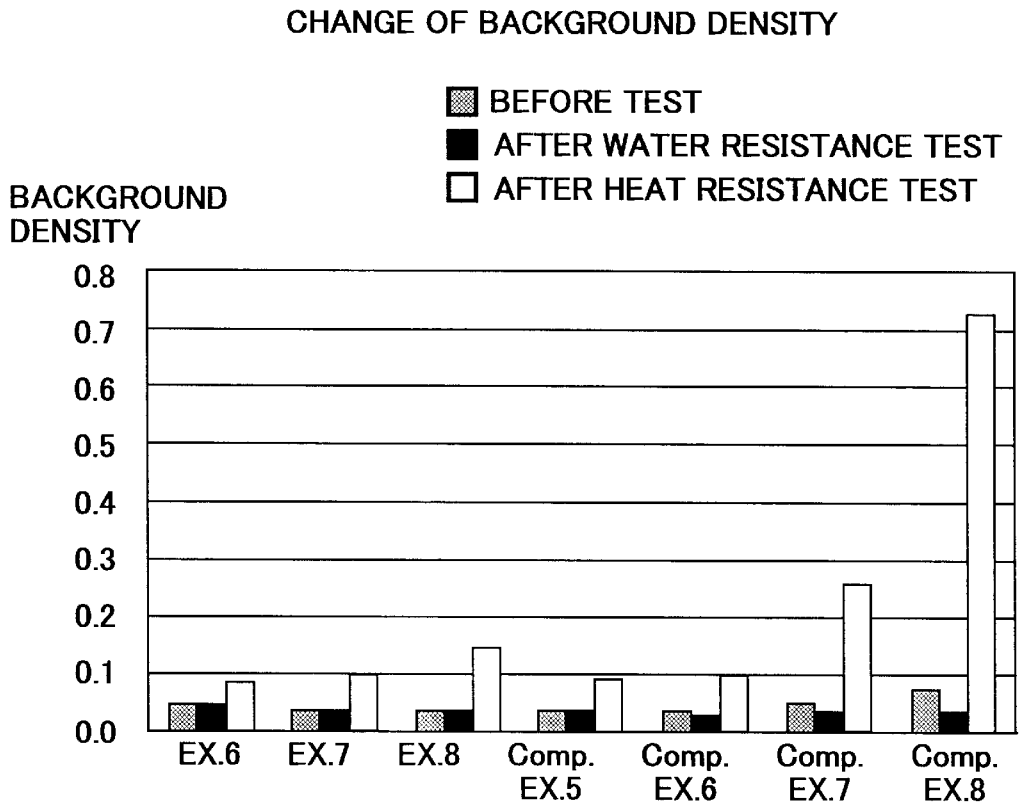
FIG. 1 is a graph showing the preservation properties of the thermosensitive recording media of Examples 6–8 and Comparative Examples 5–8 by comparing the background densities after preservation tests.

The thermosensitive recording medium of the present invention includes a support and a thermosensitive recording layer including at least a leuco dye, a color developer and a sensitizer. The color developer includes at least a compound selected from the group consisting of the following compounds:

(1) compounds having one of formulae (1) to (3) mentioned above;
(2) methylenebis(2-naphthol; and
(3) condensation products of a carboxylic acid component including (poly-)4-hydroxybenzoic acid (hereinafter referred to as 4-hydroxybenzoic acid compound) with a polyhydric alcohol component including a polyhydric alcohol having three or more hydroxyl groups, which have formula
(4) mentioned above.

In addition, the sensitizer includes at least 4-acetylbiphenyl. The thermosensitive recording medium has so good heat resistance as to be used for POS labels for hot foods, boxed lunches, dairy dishes, etc. In addition, the recording medium of the present invention has high thermosensitivity.

When a compound having formula (1), (2) or (3) is used as a color developer together with 4-acetylbiphenyl (i.e., a sensitizer), the content of the compound in the recording layer is preferably from 1 to 5 parts by weight, and more preferably 1.5 to 4.5 parts by weight per 1 part by weight of the leuco dye included therein. When the content of the color developer is too low, the resultant recording medium produces images having low image density. To the contrary, when the content is too high, images formed in the resultant recording medium have low image density. This is because the residue of the color developer, which is not used for coloring (i.e., forming images), mixes with the colored reaction product of the leuco dye with the color developer, resulting in decrease of image density.

The content of 4-acetylbiphenyl is preferably from 0.1 to 4 parts by weight, and more preferably 0.5 to 3.5 parts by weight per 1 part by weight of the leuco dye included therein. When the content is too low, the thermosensitivity of the resultant recording medium is hardly improved. To the contrary, when the content of 4-acetylbiphenyl is too high, images formed in the resultant recording medium have low image density because the residue of 4-acetylbiphenyl mixes with the colored reaction product.

The weight ratio of the compound having formula (1), (2) or (3) to 4-acetylbiphenyl is from 3/7 to 9/1.

The present inventors discover that when methylenebis (2-naphthol) is used as a color developer and 3-diethylamino-6-ethyl-7-(3-methylanilino) fluoran is used as a leuco dye, the resultant recording medium has good preservability, i.e., the images produced in the recording medium hardly discolor. The reason is not yet determined, however, is considered as follows:

The raw material of methylenebis (2-naphthol) is naphthol, which has strong sublimation property. Therefore it is considered that methylenebis (2-naphthol) also has considerable sublimation property. When methylenebis (2-naphthol) is mixed with 3-diethylamino-6-ethyl-7-(3-methylanilino)fluoran or the like compound upon application of heat to form a colored image (i.e., a colored reaction product), both the compounds mix with each other better and react with each other stronger than in other cases in which methylenebis (2-naphthol) is mixed with another coloring agent.

Methylenebis (2-naphthol) has advantages such as low cost and good coloring property. As a result of the present inventors' investigation of the thermosensitive recording medium using methylenebis(2-naphthol), when methylenebis(2-naphthol) is used in combination with 4-acetylbiphenyl or 3-diethylamino-6-ethyl-7-(3-methylanilino)fluoran, the resultant recording medium has a combination of high sensitivity, high image density and good heat resistance (i.e., low discoloring property).

Figure 2:
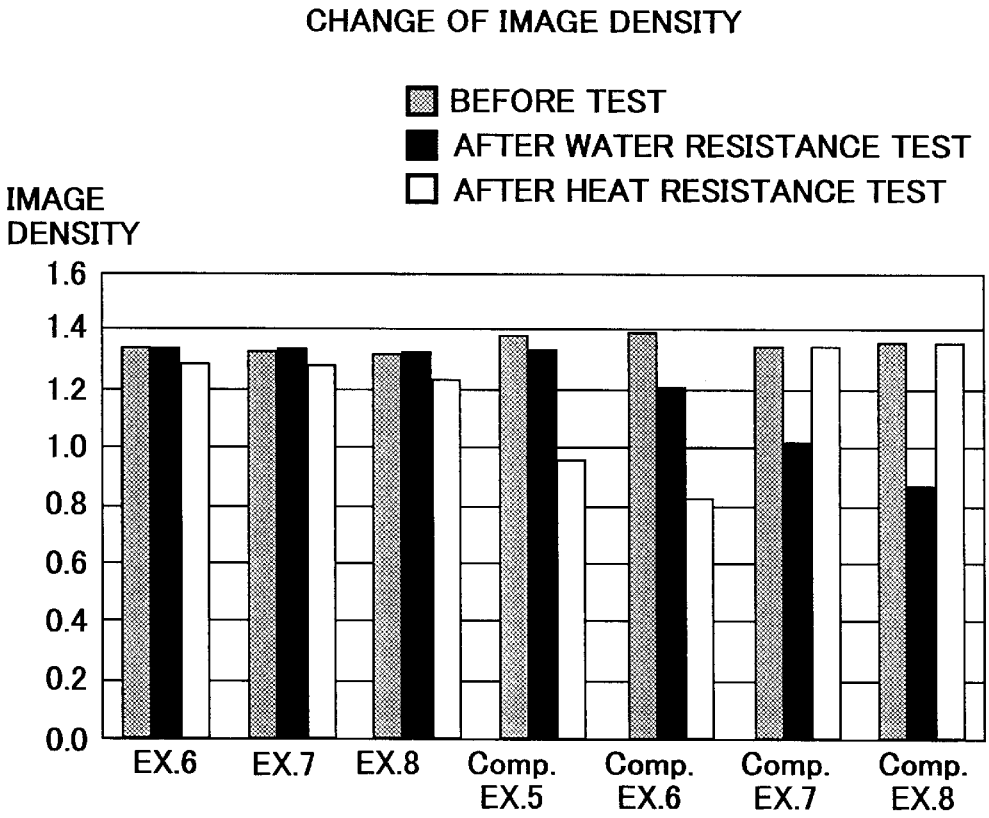
FIG. 2 is a graph showing preservation properties of the thermosensitive recording media of Examples 6–8 and Comparative Examples 5–8 by comparing the image densities after preservation tests.
Figure 3:
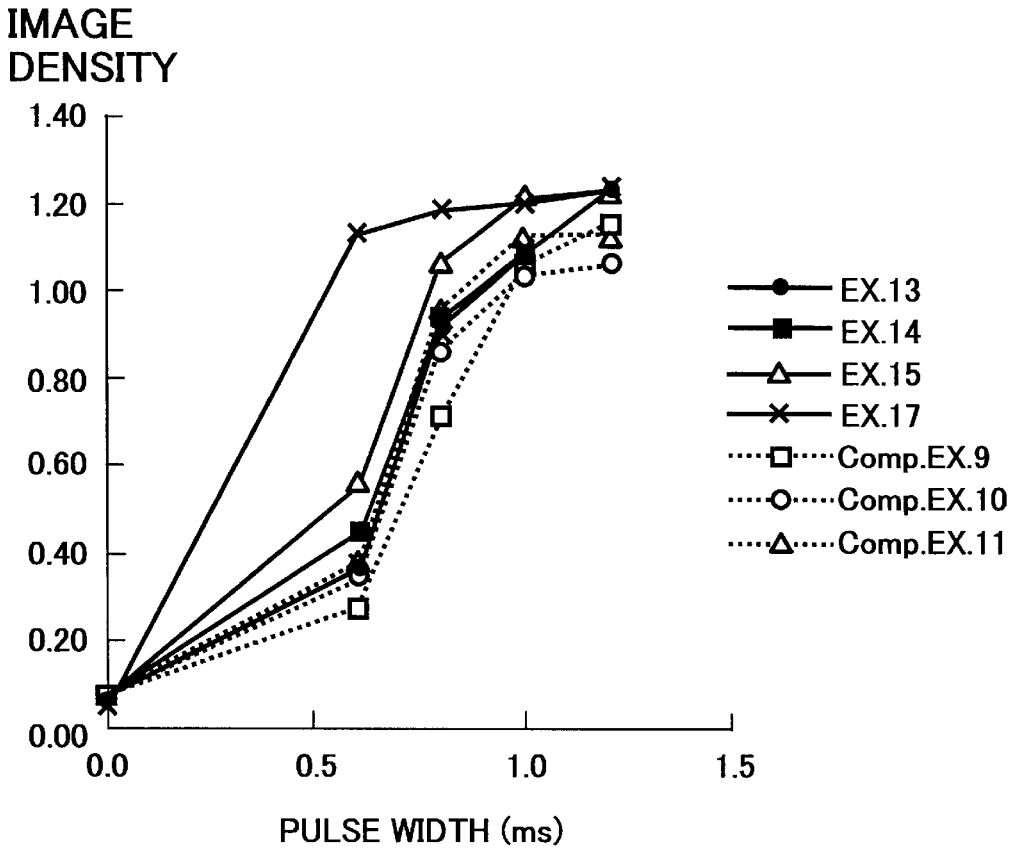
FIG. 3 is a graph showing relationship between applied energy and image density in the thermosensitive recording media of Examples 13–17 and Comparative Examples 9–11.

FIGS. 1 and 2 are graphs in which the heat resistance and water resistance of the recording media using a combination of methylenebis(2-naphthol) with the above-mentioned compounds are compared with those of the recording media using a combination of methylenebis(2-naphthol) with a compound other than the above-mentioned compounds or the recording media which do not use methylenebis(2-naphthol) while comparing the image densities and background densities.

As can be understood from FIGS. 1 and 2, the recording medium of the present invention has a combination of good heat resistance and water resistance. Thus, thermosensitive recording medium, which has good image qualities and good preservability and which does not bisphenol A, can be provided. Bisphenol A is considered to be one of the endocrine disputing chemicals and therefore a strong need has been existing for such a thermosensitive recording medium that does not include bisphenol A.

To use methylenebis(2-naphthol) as a color developer is disclosed in Japanese Laid-Open Patent Publication No. 57-39986. In addition, to use 4-acetylbiphenyl as a sensitizer is also disclosed in Japanese Laid-Open Patent Publication No. 61-246088. However, as can be clearly understood by the below description in the section of Examples, by using a combination of methylenebis(2-naphthol) with 4-acetylbiphenyl, unexpected results are produced, i.e., the resultant thermosensitive recording medium has a combination of good image qualities and good image preservability. Namely, it is not known that when a combination of methylenebis(2-naphthol) with 4-acetylbiphenyl and/or 3-diethylamino-6-ethyl-7-(3-methylanilino)fluoran is used in a thermosensitive recording medium, the resultant recording medium peculiarly has a combination of good image qualities and good image preservability.

When a combination of methylenebis(2-naphthol) with 4-acetylbiphenyl is used in a recording medium, the content of methylenebis(2-naphthol) in the recording medium is preferably from 100 to 700 parts by weight, and more preferably from 250 to 550 parts by weight, per 100 parts by weight of the leuco dye included therein.

The content of 4-acetylbiphenyl (i.e., the sensitizer) in the recording medium is preferably from 20 to 300 parts by weight, and more preferably from 50 to 250 parts by weight, per 100 parts by weight of the leuco dye included therein. When the content of 4-acetylbiphenyl is too low, the thermosensitivity is hardly improved. When the content is too high, the thermosensitivity is not further improved and image density decreases.

The thermosensitive composition mentioned above is coated on a support such as paper, films, synthetic paper and the like materials to form a thermosensitive recording layer. The recording layer preferably includes a compound having formula (5) mentioned above (i.e., an ultraviolet absorbent)

Specific examples of such a compound having formula (5) include:

2-(2'-hydroxy-5'-methylphenyl)benzotriazole (for example, a photostabilizer SUMISORB 200 manufactured by Sumitomo Chemical Co., Ltd.), 2-(2'-hydroxy-3'-tert-butyl-5'-methylphenyl)-5-chlorobenzotriazole (for example, a photostabilizer SUMISORB 300 manufactured by Sumitomo Chemical Co., Ltd.), 2-(2'-hydroxy-3',5'-di-tert-butylphenyl)benzotriazole (for example, a photostabilizer SUMISORB 320 manufactured by Sumitomo Chemical Co., Ltd.), 2-(2'-hydroxy-3',5'-di-tert-amylphenyl)benzotriazole (for example, a photostabilizer SUMISORB 350 manufactured by Sumitomo Chemical Co., Ltd.), 2-(2-hydroxy-5'-tert-butylphenyl)benzotriazole, 2-(2'-hydroxy-5'-tert-octylphenyl)benzotriazole (for example, a photostabilizer SUMISORB 340 manufactured by Sumitomo Chemical Co., Ltd.), and 2-(2'-hydroxy-3',5'-di-tert-butylphenyl)-5-chlorobenzotriazole.

Among these compounds, 2-(2'-dyroxy-5'-methylphenyl) benzotriazole, and 2-(2'-hydroxy-3'-tert-butyl-5'-methylphenyl)-5-chlorobenzotriazole are preferable because the background area of the resultant recording medium has good light resistance.

The content of such a compound having formula (5) in the recording layer is preferably from 30 to 300 parts by weight, and more preferably from 50 to 250 parts by weight, per 100 parts by weight of the leuco dye included therein. The content of such a compound is too low, the light resistance is not satisfactory. The content is too high, the light resistance is not further improved, and the image density decreases.

In the present invention, a condensation product (hereinafter referred to as a 4-hydroxybenzoate derivative) of 4-hedroxybenzoic acid compound with a polyhydric alcohol having three or more hydroxyl groups, which has formula (4), can also be used as a color developer. The resultant recording medium has high thermosensitivity, particularly when a compound having formula (6) mentioned above is used as the polyhydric alcohol.

The high sensitivity of the recording material including a 4-hydroxybenzoate derivative is supported by the following experimental results.

One part by weight of a powder of a 4-hydroxybenzoate derivative (tradenamed as K-5 and manufactured by ASAHI DENKA KOGYO, softening point of 115° C.) was mixed with one part by weight of a powder of 4-acetylbiphenyl (melting point of 120° C.) and the mixture was heated at a temperature rising speed of 2° C./min from 60° C. while carefully observing the mixture. At 107° C., which is lower than the melting point of 4-acetylbiphenyl), the mixture started to melt, and the mixture achieved a transparent state at 109° C.

To the contrary, when this procedure was repeated except that the 4-hydroxybenzoate derivative was replaced with bis(4-methylbenzyl) oxalate (melting point of 101° C.), which is disclosed as a sensitizer in WO99/51444, the mixture started to gradually melt at a temperature slightly higher than 101° C., and the mixture achieved a transparent liquid state at 120° C.

Therefore, it can be said that the former mixture has higher thermosensitivity than the latter mixture although the softening point of the 4-hydroxybenzoate derivative is higher than the melting point of bis(4-methylbenzyl) oxalate. The reason is considered to be that the compatibility of 4-acetylbiphenyl with the 4-hydroxybenzoate derivative is higher than that with bis(4-methylbenzyl) oxalate. Therefore, it is considered that when 4-acetylbiphenyl is melted (i.e., the mixture is melted at a relatively low temperature (107° C.) due to the mixture effect), 4-acetylbiphenyl quickly mixes with the 4-hydroxybenzoate derivative.

Namely, by using a combination of a 4-hydroxybenzoate derivative with 4-acetylbiphenyl, the thermosensitivity of the resultant recording medium can be dramatically improved.

This experiment is made only for explaining the difference between the thermosensitivities of an example of the recording medium of the present invention and a conventional recording medium. The formulation of the mixture and heating method mentioned above are only an example of the present invention, and the present invention is not limited thereto.

In addition, when the above-mentioned procedure was repeated except that the 4-hydroxybenzoate derivative was replaced with diphenylsulfone (melting point of 128° C.), which is also disclosed as a sensitizer in WO99/51444, the mixture started to melt at 114° C. lower than the melting point of diphenylsulfone (128° C.), and the mixture achieved a transparent liquid state at 117° C. Although diphenylsulfone has good compatibility with the (poly-) 4-hydroxy benzozte derivative, the image density of the resultant images is low and therefore the recording medium cannot be practically used. This is because the melting point of diphenylsulfone is higher than that of 4-acetylbiphenyl.

With respect to coloring mechanism and thermosensitivity of thermosensitive recording media, various theories have been advocated. However, it is difficult to theoretically design a recording medium of practical use. It is well known in this art that when the melting point and/or compatibility of the materials used in the recording layer slightly change, the coloring properties of the resultant recording media largely change. In fact, the present invention is made after many trials and errors.

The content of the 4-hydroxy benzoate derivative in the recording layer is preferably from 1 to 5 parts by weight, and more preferably from 2 to 3.5 parts by weight, per 1 part by weight of the leuco dye included therein.

The content of the 4-acetylbiphenyl in the recording layer is preferably from 0.1 to 5 parts by weight, and more preferably from 0.5 to 3 parts by weight, per 1 part by weight of the leuco dye included therein.

When the content of the 4-hydroxy benzoate derivative is too low, the image density of the produced images is not satisfactory. When the content thereof is too high, the image density decreases because the residue of the derivative, which does not contribute to coloring, remains in the recording layer.

Similarly, when the content of 4-acetylbiphenyl is too low, the image density of the produced images is not satisfactory. When the content thereof is too high, the image density decreases because the residue of the derivative, which does not contribute to coloring, remains in the recording layer.

In addition, condensation products of a carboxylic acid component including a 4-hydroxybenzoic acid compound and at least one of a monobasic carboxylic acid and a dibasic carboxylic acid with a polyhydric alcohol component including a polyhydric alcohol having three or more hydroxyl groups and a dihydric alcohol can be used as the color developer in the present invention.

The thermosensitive recording medium of the present invention may include tetrakis(1,2,2,6,6-pentamethyl-4-piperidyl)-1,2,3,4-butanetetracarboxylate and/or tetrakis(2,2,6,6-tetramethyl-4-piperidyl)-1,2,3,4-butanetetracarboxylate as a preservation stabilizer together with a 4-hydroxy benzoate derivative to prevent coloring of the background area of recorded images (i.e., to improve the preservation property of the resultant recording medium).

The content of such a preservation stabilizer in the recording layer including a 4-hydroxy benzoate derivative as a color developer is preferably 0.01 to 1 part by weight, and more preferably from 0.05 to 0.3 parts by weight, per 1 part by weight of the color developer included therein. When a combination of the butanetetracarboxylate compounds mentioned above is used, the content thereof is preferably from 0.01 to 1 part by weight.

The content of the preservation stabilizer is too low, the effect is hardly exerted. When the content is too high, the image density decreases because of increase of the remaining stabilizer.

In the thermosensitive recording layer, one or more leuco dyes are used as a coloring agent. Suitable leuco dyes for use in the recording layer include known leuco dyes such as triphenyl methane compounds, fluoran compounds, phenothiazine compounds, auramine compounds, spiropyran compounds, indolinophthalide and the like compounds. These leuco dyes are used alone or in combination.

Specific examples of such leuco dyes include the following compounds.

3,3-bis(p-dimethylaminophenyl)phthalide, 3,3-bis(p-dimethylaminophenyl)-6-dimethylaminophthalide (i.e., crystal violet lactone), 3,3-bis(p-dimethylaminophenyl)-6-diethylaminophthalide, 3,3-bis(p-dimethylaminophenyl)-6-chlorophthalide, 3,3-bis(p-dibutylaminophenyl)phthalide, 3-cyclohexylamino-6-chlorofluoran, 3-dimethylamino-5,7-dimethylfluoran, 3-N-methyl-N-isobutyl-6-methyl-7-anilinofluoran, 3-N-ethyl-N-isoamyl-6-methyl-7-anilinofluoran, 3-diethylamino-7-chlorofluoran, 3-diethylamino-7-methylfluoran, 3-diethylamino-7,8-benzfluoran, 3-diethylamino-6-methyl-7-chlorofluoran, 3-(N-p-tolyl-N-ethylamino)-6-methyl-7-anilinofluoran, 3-pilolidino-6-methyl-7-anilinofluoran, 2-{N-(3'-trifluoromethylphenyl)amino}-6-diethylaminofluoran, 2-{3,6-bis(diethylamino)-9-(o-chloroanilino)xanthyl benzoic acid lactam}, 3-diethylamino-6-methyl-7-(m-trichloromethylanilino)fluoran, 3-diethylamino-7-(o-chloroanilino)fluoran, 3-dibutylamino-7-(o-chloroanilino)fluoran, 3-(N-ethyl-N-amylamino)-6-methyl-7-anilinofluoran, 3-(N-methyl-N-cyclohexylamino)-6-methyl-7-anilinofluoran, 3-diethylamino-6-methyl-7-anilinofluoran, 3-diethylamino-6-methyl-7-(2',4'-dimethylanilino)fluoran, 3-(N,N-diethylamino)-5-methyl-7-(N,N-dibenzylamino)fluoran, benzoyl leuco methylene blue, 6'-chloro-8'-methoxy-benzoindolino-spiropyran, 6'-bromo-3'-methoxy-benzoindolino-spiropyran, 3-(2'-hydroxy-4'-dimethylaminophenyl)-3-(2'-methoxy-5'-chlorophenyl)phthalide, 3-(2'-hydroxy-4'-dimethylaminophenyl)-3-(2'-methoxy-5'-nitrophenyl)phthalide, 3-(2'-hydroxy-4'-diethylaminophenyl)-3-(2'-methoxy-5'-methylphenyl)phthalide, 3-(2'-methoxy-4'-dimethylaminophenyl)-3-(2'-hydroxy-4'-chloro-5'-methylphenyl)phthalide, 3-diethylamino-6-ethyl-7-(3-methylanilino)fluoran, 3-morpholino-7-(N-propyl-trifluoromethylanilino)fluoran, 3-pyrrolidino-7-trifluoromethylanilinofluoran, 3-diethylamino-5-chloro-7-(N-benzyl-trifluoromethylanilino)fluoran, 3-pyrrolidino-7-(di-p-chlorophenyl)methylaminofluoran, 3-diethylamino-5-chloro-7-(α-phenylethylamino)fluoran, 3-(N-ethyl-p-toluidino)-7-(α-phenylethylamino)fluoran, 3-diethylamino-7-(o-methoxycarbonylphenylamino)fluoran, 3-diethylamino-5-methyl-7-(α-phenylethylamino)fluoran, 3-diethylamino-7-piperidinofluoran, 2-chloro-3-(N-methyltoluidino)-7-(p-n-butylanilino) fluoran, 3-(N-methyl-N-isopropylamino)-6-methyl-7-anilinofluoran, 3-dibutylamino-6-methyl-7-anilinofluoran, 3,6-bis(dimethylamino)fluorenespiro(9,3')-6'-dimethylaminophthalide, 3-(N-benzyl-N-cyclohexylamino)-5,6-benzo-7-α-naphthylamino-4'-bromofluoran, 3-diethylamino-6-chloro-7-anilinofluoran, 3-{N-ethyl-N-(2-ethoxypropyl)amino}-6-methyl-7-anilinofluoran, 3-{N-ethyl-N-(tetrahydrofurfuryl)amino}-6-methyl-7-anilinofluoran, 3-diethylamino-6-methyl-7-mesidino-4',5'-benzofluoran, 3-(p-dimethylaminophenyl)-3-{1,1-bis(p-dimethylaminophenyl)ethylene-2-yl}phthalide, 3-(p-dimethylaminophenyl)-3-{1,1-bis(p-dimethylaminophenyl)ethylene-2-yl}-6-dimethylaminophthalide, 3-(p-dimethylaminophenyl)-3-(1-p-dimethylaminophenyl-1-phenylethylene-2-yl) phthalide, 3-(p-dimethylaminophenyl)-3-(1-p-dimethylaminophenyl-1-p-chlororophenylethylene-2-yl)-6-dimethylaminophthalide, 3-(4'-dimethylamino-2'-methoxy)-3-(1"-p-dimethylaminophenyl-1"-p-chlorophenyl-1",3"-butadiene-4"-yl)benzophthalide, 3-(4'-dimethylamino-2'-benzyloxy)-3-(1"-p-dimethylaminophenyl-1"-phenyl-1",3"-butadiene-4"-yl)benzophthalide, 3-dimethylamino-6-dimethylamino-fluorene-9-spiro-3'(6'-dimethylamino)phthalide, 3,3-bis{2-(p-dimethylaminophenyl)-2-(p-methoxyphenyl)ethenyl}-4,5,6,7-tetrachlorophthalide, 3-bis{1,1-bis(4-pyrrolidinophenyl)ethylene-2-yl}-5,6-dichloro-4,7-dibromophthalide, bis(p-dimethylaminostyryl)-1-naphthalenesulfonylmethane, bis(p-dimethylaminostyryl)-1-p-tolylsulfonylmethane, and the like.

The color developer for use in the recording layer are mentioned above. If necessary, an additive, which has an electron accepting property similarly to the color developers but which has less color developing ability than the color developers, such as hindered phenol compounds, can be used in combination thereof. Specific examples of the additive include:

2,2'-methylenebis(4-ethyl-6-tert-butylphenol), 4,4'-butylidenebis(6-tert-butyl-2-methylphenol), 1,1,3-tris(2-methyl-4-hydroxy-5-cyclohexylphenyl) butane, 4,4'-thiobis(6-tert-butyl-2-methylphenol), tetrabromobisphenol A, tetrabromobisphenol S, 4,4'-thiobis(2-methylphenol), 4,4'-thiobis(2-chlorophenol), and the like compounds.

The thermosensitive recording layer may include a binder resin, if necessary, to bind the leuco dye, color developer and sensitizer on a support or an undercoat layer mentioned below.

Specific examples of such a binder resin include water-soluble resins such as polyvinyl alcohol, starch and its derivatives, cellulose derivatives (e.g., hydroxymethylcellulose, hydroxyethylcellulose, carboxymethylcellulose, methylcellulose, and ethylcellulose) polyacrilic acid sodium salts, polyvinylpyrrolidone, acrylamide/acrylate copolymers, acrylamide/acrylate/methacrylic acid copolymers, alkali metal salts of styrene/maleic anhydride copolymers, alkali metal salts of isobutylene/maleic anhydride copolymers, polyacrylamide, sodium alginate, gelatin, casein, etc; and emulsions and latexes of resins such as polyvinyl acetate, polyurethane, polyacrylic acid, polyacrylate, vinyl chloride/vinyl acetate copolymers, polybutyl methacrylate, ethylene/vinyl acetate copolymers, styrene/butadiene copolymers, styrene/butadiene/acrylate copolymers, etc.

The thermosensitive recording medium of the present invention may include one or more thermofusible materials. When the recording medium is used for POS labels for hot foods, and boxed lunches, it is preferable that such a thermofusible material is not used or a thermofusible material having a melting point not less than 100° C. is used. Specific examples of such thermofusible materials include fatty acids such as stearic acid and behenic acid; amides such as stearic acid amide, palmitic acid amide; fatty acid metal salts such as zinc stearate, aluminum stearate, calcium stearate, zinc palmitate, and zinc behenate; p-benzylbiphenyl, terphenyl, triphenylmethane, benzyl p-benzyloxybenzoate, β-benzyloxynaphthalene, phenyl β-naphtoate, phenyl 1-hydroxy-2-naphthoate, methyl 1-hydroxy-2-naphthoate, diphenyl carbonate, guaiacol carbonate, dibenzyl terephthalate, dimethyl terephthalate, 1,4-dimethoxynaphthalene, 1,4-diethoxynaphthalene, 1,4-dibenzyloxynaphthalene, 1,2-diphenoxyethane, 1,2-bis(3-methylphenoxy)ethane, 1,2-bis(4-methylphenoxy)ethane, 1,4-diphenoxy-2-butene, 1,2-bis(4-methoxyphenylthio) ethane, dibenzoylmethane, 1,4-diphenylthiobutane, 1,4-diphenylthio-2-butene, 1,3-bis(2-vinyloxyethoxy)benzene, 1,4-bis(2-vinyloxyethoxy)benzene, p-(2-vinyloxyethoxy) biphenyl, p-aryloxybiphenyl, p-propargyloxybiphenyl, dibenzoyloxymethane, dibenzoyloxypropane, dibenzyldisulfide, 1,1-diphenylethanol, 1,1-diphenylpropanol, p-benzyloxybenzylalcohol, 1,3-phenoxy-2-propanol, N-octadecylcarbamoyl-p-methoxycarbonylbenzene, N-octadecylcarbamoylbenzene, 1,2-bis(4-methoxyphenoxy)propane, 1,5-bis(4-methoxyphenoxy)-3-oxapentane, and the like compounds.

The thermosensitive recording medium may include one or more other additives such as fillers, surfactants, lubricants, pressure-induced-coloring preventers, etc.

Specific examples of such fillers include inorganic particulate materials such as calcium carbonate, silica, zinc oxide, titanium oxide, aluminum hydroxide, zinc hydroxide, barium sulfate, clay, kaolin, talc, and surface-treated calcium carbonate and silica; and organic particulate materials such as urea-folmaldehyde resins, styrene-methacrylic acid copolymers, polystyrene resins, vinylidene chloride resins, etc.

Specific examples of the lubricants include higher fatty acids and their metal salts, higher fatty acid amides, higher fatty acid esters, waxes such as animal waxes, vegetable waxes, and mineral waxes, etc.

The thermosensitive recording medium of the present invention preferably include an undercoat layer, which mainly includes hollow particles, between the support and the recording layer to improve the thermosensitivity thereof.

The hollow particles have a resin shell, and preferably have a hollow rate of not less than 30%, and preferably from 70 to 98%, and an weight average particle diameter of from 0.4 to 10 μm. At this point, the hollow rate is defined as follows:

$$\text{Hollow rate } (\%) = (Di/Do) \times 100$$

wherein Di represents the inside diameter of a hollow particle (i.e., a diameter of a hollow in a hollow particle), and Do represents the outside diameter of the hollow particle.

When hollow particles having a too low hollow rate, the thermosensitivity is hardly improved because the heat applied to the recording medium by a thermal printhead easily escapes from the support side thereof.

With respect to the average particle diameter of the hollow particles, it is hard to manufacture hollow particles having such an average particle diameter as not greater than 0.4 μm. When the average particle diameter of the hollow particles is too large, the smoothness of surface of the resultant undercoat layer decreases, resulting in deterioration of thermosensitivity of the resultant recording medium because a thermal printhead cannot fully contact the surface of the recording medium. Therefore, hollow particles having an average particle diameter in this range are preferable. In addition, it is preferable to use hollow particles having a sharp particle diameter distribution peak in the undercoat layer.

The hollow particles for use in the undercoat layer of the recording medium of the present invention has a thermoplastic resin shell. Suitable resins for use as the shell include polystyrene, polyvinyl chloride, polyvinylidene chloride, polyvinyl acetate, polyacrylonitrile, polybutadiene and copolymers of these resins. Among these resins, copolymers of vinylidene chloride and acrylonitrile are preferable.

By using hollow particles in the undercoat layer, the adhesion of a thermal printhead with the surface of the recording medium can be improved, resulting in increase of thermosensitivity because the undercoat layer has good heat insulating property and good cushionability.

The undercoat layer is typically formed by, for example, the following method:

(1) preparing a coating liquid in which hollow particles are dispersed in water together with a binder resin such as water-soluble resins and aqueous emulsions of resins; and
(2) coating the coating liquid on a support and then drying the coated liquid.

The weight of the undercoat layer is preferably not less than 1 g/m$^2$ and more preferably from 2 to 15 g/m$^2$. The content of the binder resin in the undercoat layer is preferably from 2 to 50% by weight based on the total of the binder resin and hollow particles in the undercoat layer.

Suitable binder resins for use in the undercoat layer include known water-soluble resins and aqueous resin emulsions. Specific examples of such binder resins include water-soluble resins such as polyvinyl alcohol, starch and its derivatives, cellulose derivatives (e.g., methoxycellulose, hydroxyethylcellulose, carboxymethylcellulose, methylcellulose, and ethylcellulose), polyacrilic acid sodium salts, polyvinylpyrrolidone, acrylamide/acrylate copolymers, acrylamide/acrylate/methacrylic acid copolymers, alkali metal salts of styrene/maleic anhydride copolymers, alkali metal salts of isobutylene/maleic anhydride copolymers, polyacrylamide, sodium alginate, gelatin, casein, etc; and latexes and emulsions of resins such as styrene/butadiene copolymers, styrene/butadiene/acrylate copolymers, polyvinyl acetate, vinyl acetate/acrylate copolymers, styrene/acrylate copolymers, polyacrylates, polyurethane, etc.

The thermosensitive recording medium may include a protective layer on the recording layer, to improve the light resistance thereof. The protective layer is typically constituted of a binder resin (e.g., water-soluble resins, aqueous emulsions of resins and water-insoluble resins), and a filler (e.g., calcium carbonate, silica, aluminum hydroxide, etc.). In addition, an ultraviolet crosslinking resin or an electron beam crosslinking resin can be used as the binder resin.

The protective layer preferably include a compound having formula (5) to improve the light resistance of the resultant recording medium. The compound is included in the protective layer by, for example, one of the following methods:

(1) coating a coating liquid in which such a compound is dispersed similarly to the filler to be added, and then drying the coated liquid; and
(2) coating a coating liquid including microcapsule, in which such a compound dissolved in a solvent is microencapsulated, and then drying the coated liquid.

The content of such a compound in the protective layer is preferably from 2 to 30% by weight, and more preferably from 3 to 20% by weight, on the dry basis. When the content of such a compound is too low, the light resistance is hardly improved. When the content is too high, the barrier property of the protective layer, which is the main function of the protective layer, deteriorates, and in addition, the produced images are easily discolored when contacted with a plasticizer.

The recording material of the present invention may include a back layer, for example, to prevent curling thereof.

The support for use in the recording medium of the present invention is not particularly limited, and paper, recycled paper, one-side glazed paper, oil resistant paper, coated paper, art paper, cast-coated paper, micro-coat paper, resin-laminated paper, polyolefin type synthetic paper, resin films, etc., can be used as the support.

The recording medium of the present invention can be prepared, for example, by applying coating liquids such as an undercoat layer coating liquid a recording layer coating liquid a protective layer coating liquid on a support one by one or at the same time, and then drying the coated liquids one by one or at the same time.

It is preferable that the undercoat layer, recording layer and/or protective layer are subjected to calendering to improve adhesion of the surface of the recording medium with a printing head such as thermal printheads. Namely it is possible to prepare a thermosensitive recording medium which can produce high definition images having less background development by controlling the smoothness of the surface of the recording medium by controlling the pressure in the calendering process and the moisture in the recording medium before calendering.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

(Preparation of Recording Layer)

The following components were mixed and dispersed using a sand mill such that the solid components in the liquids had an average particle diameter not greater than 1.0 μm. Thus, liquids A, B and C were prepared.

| Formulation of liquid A | |
|---|---|
| 3-(N-ethyl-N-isoamylamino)-6-methyl-7-anilinofluoran (i.e., leuco dye) | 20 |
| 10% polyvinyl alcohol aqueous solution | 20 |
| Water | 60 |
| **Formulation of liquid B** | |
| Compound having formula (1) | 20 |
| 10% polyvinyl alcohol aqueous solution | 20 |
| Silica | 10 |
| Water | 50 |
| **Formulation of liquid C** | |
| 4-acetylbiphenyl | 20 |
| 10% polyvinyl alcohol aqueous solution | 20 |
| Water | 60 |

The following components were mixed to prepare a recording layer coating liquid.

| Formulation of recording layer coating liquid | |
|---|---|
| Liquid A | 10 |
| Liquid B | 30 |
| Liquid C | 25 |

The thus prepared recording layer coating liquid was coated on a paper having a weight of 52 g/m$^2$ and then dried to form a recording layer in which the leuco dye was included in an amount of 0.5 g/m$^2$. The coated paper was subjected to calendering such that the surface of the recording layer had a smoothness of from 500 to 800 seconds.

Thus, a thermosensitive recording medium of Example 1 was prepared.

Example 2

The procedure for preparation of the recording medium in Example 1 was repeated except that 3-(N-ethyl-N-isoamylamino)-6-methyl-7-anilinofluoran in liquid A was replaced with 20 parts of 3-dibutylamino-6-methyl-7-anilinofluoran.

Thus, a thermosensitive recording medium of Example 2 was prepared.

Example 3

The procedure for preparation of the recording medium in Example 1 was repeated except that the compound having formula (1) in liquid B was replaced with 20 parts of a compound having formula (2).

Thus, a thermosensitive recording medium of Example 3 was prepared.

Example 4

The procedure for preparation of the recording medium in Example 1 was repeated except that the compound having formula (1) in liquid B was replaced with 20 parts of a compound having formula (3).

Thus, a thermosensitive recording medium of Example 4 was prepared.

Example 5

(Preparation of Undercoat Layer)

The following components were mixed to prepare an undercoat layer coating liquid (i.e., liquid D).

| Formulation of undercoat layer (liquid D) | |
|---|---|
| Dispersion including spherical hollow particles (average particle diameter of 4 $\mu$m, hollow rate of 90%, and solid content of 40%) | 25 |
| Styrene/butadiene copolymer latex (solid content of 50%) | 20 |
| Water | 55 |

The thus prepared undercoat layer coating liquid was coated on a paper having a weight of 52 g/m$^2$ and then dried to form an undercoat layer having a weight of 3.5 g/m$^2$.

Then the procedure for preparation of the recording layer in Example 1 was repeated to form the recording layer on the undercoat layer.

The coated paper was subjected to calendering such that the surface of the recording layer had a smoothness of from 500 to 800 seconds.

Thus, a thermosensitive recording medium of Example 5 was prepared.

Comparative Example 1

The procedure for preparation of the recording medium in Example 1 was repeated except that the recording layer coating liquid was prepared without using liquid C.

Thus, a thermosensitive recording medium of Comparative Example 1 was prepared.

Comparative Example 2

The procedure for preparation of the recording medium in Example 1 was repeated except that 4-acetylbiphenyl in liquid C was replaced with 20 parts of bis(p-methylbenzyl) oxalate.

Thus, a thermosensitive recording medium of Comparative Example 2 was prepared.

Comparative Example 3

The procedure for preparation of the recording medium in Example 2 was repeated except that the compound having formula (1) in liquid B was replaced with 20 parts of 4-isopropoxy-4'-hydroxydiphenylsulfone, and 4-acetylbiphenyl in liquid C was replaced with 20 parts of bis(p-methylbenzyl) oxalate.

Thus, a thermosensitive recording medium of Comparative Example 3 was prepared.

Comparative Example 4

The procedure for preparation of the recording medium in Example 2 was repeated except that the compound having formula (1) in liquid B was replaced with 20 parts of 4-isopropoxy-4'-hydroxydiphenylsulfone.

Thus, a thermosensitive recording medium of Comparative Example 4 was prepared.

The thus prepared thermosensitive recording media of Examples 1 to 5 and Comparative Examples 1 to 4 were subjected to a printing test using a printing simulator manufactured by Ohkura Electric Co., Ltd. The printing conditions are as follows:

Pulse width of voltage applied to thermal printhead: 0.5, 0.7 and 0.9 ms (3 energy levels)

The recorded images were evaluated as follows:

(1) Image Density

The image densities of the recorded images were measured by a reflection densitometer, Macbeth RD-914.

(3) Preservability (Heat Resistance)

The images which were recorded under a condition of 0.9 ms in pulse width were preserved for 24 hours at 80° C.

The image densities (ID) and background densities (GD) of the images were measured by a reflection densitometer, Macbeth RD-914.

The results are shown in Table 1.

TABLE 1

| | Initial image qualities | | | | Image qualities after heat resistance test | |
|---|---|---|---|---|---|---|
| | ID (at 0.5 ms) | ID (at 0.7 ms) | ID (at 0.9 ms) | GD | GD | ID |
| Ex. 1 | 0.90 | 1.30 | 1.35 | 0.05 | 0.15 | 1.22 |
| Ex. 2 | 0.72 | 1.26 | 1.36 | 0.04 | 0.08 | 1.01 |
| Ex. 3 | 0.75 | 1.35 | 1.36 | 0.05 | 0.22 | 1.22 |
| Ex. 4 | 0.83 | 1.35 | 1.35 | 0.05 | 0.26 | 1.27 |
| Ex. 5 | 1.18 | 1.32 | 1.35 | 0.05 | 0.15 | 1.24 |
| Comp. Ex. 1 | 0.40 | 1.14 | 1.33 | 0.04 | 0.09 | 1.31 |
| Comp. Ex. 2 | 1.04 | 1.32 | 1.34 | 0.05 | 0.14 | 0.50 |
| Comp. Ex. 3 | 0.99 | 1.34 | 1.34 | 0.05 | 0.31 | 1.23 |
| Comp. Ex. 4 | 0.65 | 1.29 | 1.34 | 0.06 | 0.36 | 1.33 |

Example 6

(Preparation of Recording Layer)

The following components were mixed and dispersed using a sand mill such that the solid components in the liquids had a weight average particle diameter not greater than 1.0 μm. Thus, liquids E, F and G were prepared.

| | |
|---|---|
| Formulation of liquid E | |
| 3-dibutylamino-6-methyl-7-anilinofluoran (i.e., leuco dye) | 20 |
| 10% polyvinyl alcohol aqueous solution | 20 |
| Water | 60 |
| Formulation of liquid F | |
| Methylenebis (2-naphthol) | 20 |
| 10% polyvinyl alcohol aqueous solution | 25 |
| Amorphous silica (Tradenamed as P-603 and manufactured by Mizusawa Industrial Chemicals Ltd.) | 5 |
| Water | 50 |
| Formulation of liquid G | |
| 4-acetylbiphenyl | 20 |
| 10% polyvinyl alcohol aqueous solution | 20 |
| Water | 60 |

The following components were mixed to prepare a recording layer coating liquid.

| Formulation of recording layer coating liquid | |
|---|---|
| Liquid E | 10 |
| Liquid F | 30 |
| Liquid G | 20 |

The thus prepared recording layer coating liquid was coated on a paper having a weight of 45 g/m$^2$ and then dried to form a recording layer in which the leuco dye was included in an amount of 0.5 g/m$^2$. The coated paper was subjected to calendering such that the surface of the recording layer had a smoothness of from 500 to 800 seconds.

(Preparation of Protective Layer)

The following components were mixed and dispersed using a sand mill such that the solid components in the liquids had a weight average particle diameter of about 1.0 μm. Thus, liquids H and I were prepared.

| | |
|---|---|
| Formulation of liquid H | |
| Aluminum hydroxide (Tradenamed as H-43M and manufactured by Showa Lightmetal Corporation) | 20 |
| 10% polyvinyl alcohol aqueous solution | 20 |
| Water | 60 |
| Formulation of liquid I | |
| Montanic acid ester wax (Tradenamed as WAX-E and manufactured by Hoechst AG) | 20 |
| 10% polyvinyl alcohol aqueous solution | 20 |
| Water | 60 |

The following components were mixed to prepare a protective layer coating liquid.

| Formulation of protective layer coating liquid | |
|---|---|
| Liquid H | 15 |
| 10% polyvinyl alcohol aqueous solution | 40 |
| 25% epichlorohydrin aqueous solution | 7 |
| Liquid I | 3 |
| Water | 30 |

The protective layer coating liquid was coated on the recording layer and then dried to form a protective layer having a weight of 3.0 g/m$^2$. The coated paper was subjected to calendering such that the surface of the protective layer had a smoothness of from 800 to 3000 seconds.

Thus, a thermosensitive recording medium of Example 6 was prepared.

Example 7

(Preparation of Undercoat Layer)

The following components were mixed to prepare an undercoat layer coating liquid.

| Formulation of undercoat layer | |
|---|---|
| Dispersion including hollow particles of styrene/acrylic copolymer (Tradenamed as HP-91 and manufactured by Rohm and Haas, hollow rate of 80%, and solid content of 27.5%) | 40 |
| Styrene/butadiene copolymer latex (solid content of 50%) | 10 |
| Water | 50 |

The thus prepared undercoat layer coating liquid was coated on a paper having a weight of 45 g/m$^2$ and then dried to form an undercoat layer having a weight of 4.0 g/m$^2$.

The procedures for preparation of the recording layer and protective layer in Example 6 were repeated to form the recording layer and the protective layer one by one on the undercoat layer.

Thus a thermosensitive recording medium of Example 7 was prepared.

Example 8

The procedure for preparation of the recording medium in Example 7 was repeated except that 3-dibutylamino-6-methyl-7-anilinofluoran in liquid E was replaced with 20 parts of 3-N-ethyl-N-isoamyl-6-methyl-7-anilinofluoran.

Thus a thermosensitive recording medium of Example 8 was prepared.

Example 9

The following components were mixed and dispersed using a sand grinder such that the solid component in the liquid had a weight average particle diameter of about 1.0 μm to prepare a liquid J.

| Formulation of liquid J | |
|---|---|
| 2-(2'-hydroxy-5'-methylphenyl)benzotriazole | 20 |
| 10% polyvinyl alcohol aqueous solution | 20 |
| Water | 60 |

The procedure for preparation of the recording medium in Example 7 was repeated except that 5 parts of liquid J was added to the recording layer coating liquid.

Thus a thermosensitive recording medium of Example 9 was prepared.

Example 10

The procedure for preparation of the recording medium in Example 9 was repeated except that the addition amount of liquid J was changed from 5 parts to 25 parts.

Thus a thermosensitive recording medium of Example 10 was prepared.

Example 11

The procedure for preparation of the recording medium in Example 7 was repeated except that 3 parts of liquid J was added to the protective layer coating liquid.

Thus a thermosensitive recording medium of Example 11 was prepared.

Example 12

The procedure for preparation of the recording medium in Example 11 was repeated except that liquid J added to the protective layer coating liquid was replaced with 5 parts of a microcapsule which has an average particle diameter of 0.5 μm and a shell rate of 70% by weight and in which 2-(2'-hydroxy-5'-methylphenyl)benzotriazole is covered by a shell of a polyurethane/polyurea resin.

Thus a thermosensitive recording medium of Example 12 was prepared.

Comparative Example 5

The procedure for preparation of the recording medium in Example 7 was repeated except that 4-acetylbiphenyl in liquid G was replaced with 20 parts of bis(4-methylbenzyl) oxalate.

Thus, a thermosensitive recording medium of Comparative Example 5 was prepared.

Comparative Example 6

The procedure for preparation of the recording medium in Example 7 was repeated except that 4-acetylbiphenyl in liquid G was replaced with 20 parts of 1,2-bis (3-methylphenoxy) ethane.

Thus, a thermosensitive recording medium of Comparative Example 6 was prepared.

Comparative Example 7

The procedure for preparation of the recording medium in Comparative Example 6 was repeated except that methylenebis(2-naphthol) in liquid F was replaced with 20 parts of 4-hydroxy-4'-isopropoxydiphenylsulfone.

Thus, a thermosensitive recording medium of Comparative Example 7 was prepared.

Comparative Example 8

The procedure for preparation of the recording medium in Example 7 was repeated except that methylenebis(2-naphthol) in liquid F was replaced with 20 parts of bisphenol A.

Thus, a thermosensitive recording medium of Comparative Example 8 was prepared.

The thus prepared thermosensitive recording media of Examples 6 to 12 and Comparative Examples 5 to 8 were subjected to a printing test using a printing simulator manufactured by Ohkura Electric Co., Ltd. The printing conditions are as follows:

Printing energy: 0.45 W×0.40, 0.60, 0.80 or 1.00 ms (4 energy levels)

The recorded images were evaluated as follows:

(1) Image Density (ID) and Background Density (GD)

The image densities and background densities of the recorded images were measured by a reflection densitometer, Macbeth RD-914.

(2) Water Resistance

The images which were recorded under a printing energy condition of 0.45 W×1.0 ms were dipped into 100 ml of tap water and preserved therein for 24 hours at room temperature (20° C.).

(3) Preservability (Heat Resistance)

The images which were recorded under a printing energy condition of 0.45 W×1.0 ms were preserved for 24 hours at 80° C.

The image densities and background densities of the preserved images were measured by a reflection densitometer, Macbeth RD-914.

(4) Light Resistance

The images which were recorded under a printing energy condition of 0.45 W×1.0 ms were exposed to light of 5000 lx for 100 hours. The image densities and background densities of the preserved images were measured by a reflection densitometer, Macbeth RD-914.

The results are shown in Tables 2-1 and 2-2.

TABLE 2-1

| | Initial image qualities | | | | |
|---|---|---|---|---|---|
| | GD | ID (at 0.4 ms) | ID (at 0.6 ms) | ID (at 0.8 ms) | ID (at 1.0 ms) |
| Ex. 6 | 0.05 | 0.11 | 0.76 | 1.22 | 1.34 |
| Ex. 7 | 0.04 | 0.25 | 0.98 | 1.31 | 1.33 |
| Ex. 8 | 0.04 | 0.24 | 0.91 | 1.29 | 1.32 |
| Ex. 9 | 0.04 | 0.24 | 0.95 | 1.32 | 1.35 |
| Ex. 10 | 0.04 | 0.13 | 0.81 | 1.28 | 1.31 |
| Ex. 11 | 0.04 | 0.26 | 0.97 | 1.33 | 1.35 |
| Ex. 12 | 0.04 | 0.20 | 0.88 | 1.33 | 1.34 |
| Comp. Ex. 5 | 0.04 | 0.25 | 0.95 | 1.32 | 1.38 |
| Comp. Ex. 6 | 0.04 | 0.22 | 0.90 | 1.34 | 1.37 |
| Comp. Ex. 7 | 0.06 | 0.32 | 1.03 | 1.34 | 1.35 |

TABLE 2-1-continued

| | Initial image qualities | | | | |
|---|---|---|---|---|---|
| | GD | ID (at 0.4 ms) | ID (at 0.6 ms) | ID (at 0.8 ms) | ID (at 1.0 ms) |
| Comp. Ex. 8 | 0.08 | 0.31 | 1.06 | 1.35 | 1.36 |

TABLE 2-2

| | Image qualities after water resistance test | | Image qualities after heat resistance test | | Image qualities after light resistance test | |
|---|---|---|---|---|---|---|
| | GD | ID | GD | ID | GD | ID |
| Ex. 6 | 0.05 | 1.34 | 0.09 | 1.29 | 0.14 | 1.20 |
| Ex. 7 | 0.04 | 1.34 | 0.10 | 1.28 | 0.15 | 1.22 |
| Ex. 8 | 0.04 | 1.33 | 0.15 | 1.24 | 0.15 | 1.21 |
| Ex. 9 | 0.04 | 1.36 | 0.17 | 1.31 | 0.13 | 1.23 |
| Ex. 10 | 0.04 | 1.32 | 0.18 | 1.32 | 0.12 | 1.24 |
| Ex. 11 | 0.04 | 1.35 | 0.16 | 1.30 | 0.10 | 1.27 |
| Ex. 12 | 0.04 | 1.35 | 0.18 | 1.33 | 0.08 | 1.30 |
| Comp. Ex. 5 | 0.04 | 1.34 | 0.09 | 0.96 | 0.15 | 1.24 |
| Comp. Ex. 6 | 0.03 | 1.21 | 0.10 | 0.83 | 0.16 | 1.20 |
| Comp. Ex. 7 | 0.04 | 1.02 | 0.26 | 1.35 | 0.10 | 0.96 |
| Comp. Ex. 8 | 0.04 | 0.88 | 0.73 | 1.36 | 0.18 | 1.07 |

Example 13

(Preparation of Recording Layer)

The following components were mixed and dispersed using a sand mill such that the solid components in the liquids had an average particle diameter of about 1.0 μm. Thus, liquids K, L and M were prepared.

| | |
|---|---|
| Formulation of liquid K | |
| 3-dibutylamino-6-methyl-7-anilinofluoran | 20 |
| 10% polyvinyl alcohol aqueous solution | 20 |
| Water | 60 |
| Formulation of liquid L | |
| 4-hydroxybenzoate derivative | 20 |

having the following formula:

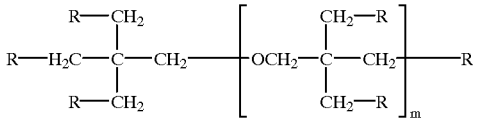

wherein m is an integer of 3 or 4, and R has the following formula:

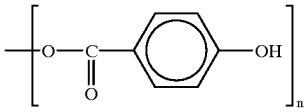

wherein n is an integer of from 10 to 12.

(Tradenamed as K-5 and manufactured by ASAHI DENKA KOGYO, a number average molecular weight of 1900, a weight average molecular weight of 2600 and softening point of 115° C.)

| | |
|---|---|
| 10% polyvinyl alcohol aqueous solution | 20 |
| Amorphous silica | 10 |
| Water | 50 |
| Formulation of liquid M | |
| 4-acetylbiphenyl | 20 |
| 10% polyvinyl alcohol aqueous solution | 20 |
| Water | 60 |

The following components were mixed to prepare a recording layer coating liquid.

| Formulation of recording layer coating liquid | |
|---|---|
| Liquid K | 10 |
| Liquid L | 30 |
| Liquid M | 10 |

The recording layer coating liquid was coated on a paper having a weight of 45 g/m$^2$ and then dried to form a recording layer in which the leuco dye was included in an amount of 0.5 g/m$^2$.

(Preparation of Protective Layer)

The following components were mixed and dispersed using a sand mill such that the solid components in the liquid had a weight average particle diameter of about 1 μm.

| | |
|---|---|
| Formulation of liquid N | |
| Aluminum hydroxide | 30 |
| 10% polyvinyl alcohol aqueous solution | 30 |
| Water | 40 |
| Formulation of liquid O | |
| Montanic acid ester wax (Tradenamed as WAX-E and manufactured by Hoechst AG) | 20 |
| 10% polyvinyl alcohol aqueous solution | 20 |
| Water | 60 |

The following components were mixed to prepare a protective layer coating liquid (i.e., liquid P).

| Formulation of protective layer coating liquid (liquid P) | |
|---|---|
| Liquid N | 15 |
| 10% polyvinyl alcohol aqueous solution | 20 |
| 25% polyepichlorohydrin aqueous solution | 7 |
| Liquid O | 3 |
| Water | 35 |

The protective layer coating liquid was coated on the recording layer and then dried to form a protective layer having a weight of 3.0 g/m$^2$.

The coated paper was subjected to calendering such that the surface of the recording medium had a smoothness of from 800 to 1500 seconds.

Thus, a thermosensitive recording medium of Example 13 was prepared.

Example 14

(Preparation of Undercoat Layer)

The following components were mixed to prepare an undecoat layer coating liquid.

| Formulation of undercoat layer coating liquid | |
|---|---|
| Dispersion including hollow particles of styrene/acrylic copolymer (Tradenamed as HP-91 and manufactured by Rohm and Haas, hollow rate of 80%, and solid content of 27.5%) | 40 |
| Styrene/butadiene copolymer latex (solid content of 50%) | 10 |
| Water | 50 |

The thus prepared undercoat layer coating liquid was coated on a paper having a weight of 45 g/m$^2$ and then dried to form an undercoat layer having a weight of 4.0 g/m$^2$.

Then the procedures for formation of the recording layer and protective layer in Example 13 were repeated to overlay a recording layer and a protective layer one by one on the undercoat layer.

Thus, a thermosensitive recording medium of Example 14 was prepared.

Example 15

The procedure for preparation of the recording medium in Example 14 was repeated except that the formulation of the recording layer coating liquid was changed as follows:

| Formulation of recording layer coating liquid | |
|---|---|
| Liquid K | 10 |
| Liquid L | 30 |
| Liquid M | 20 |

Thus, a thermosensitive recording medium of Example 15 was prepared.

Example 16

The following components were mixed and dispersed using a sand mill to prepare a liquid R.

| Formulation of liquid R | |
|---|---|
| Tetrakis(1,2,2,6,6-pentamethyl-4-piperidyl)-1,2,3,4-butanetetracarboxylate | 20 |
| 10% polyvinyl alcohol aqueous solution | 20 |
| Water | 60 |

The procedure for preparation of the recording medium in Example in Example 15 was repeated except that 3 parts of liquid R was added to the recording layer coating liquid.

Thus, a thermosensitive recording medium of Example 16 was prepared.

Example 17

The procedure for preparation of the recording medium in Example 16 was repeated except that the protective layer was not formed.

Thus a thermosensitive recording medium of Example 17 was prepared.

Example 18

The procedure for preparation of the recording medium in Example 16 was repeated except that 3-dibutylamino-6-methyl-7-anilinofluoran in liquid K was replaced with 20 parts of 3-di(n-pentyl)amino-6-methyl-7-anilinofluoran.

Thus a thermosensitive recording medium of Example 18 was prepared.

Example 19

The procedure for preparation of the recording medium in Example 16 was repeated except that 3-dibutylamino-6-methyl-7-anilinofluoran in liquid K was replaced with 20 parts of 3-(N-ethyl-N-isoamylamino)-6-methyl-7-anilinofluoran.

Thus a thermosensitive recording medium of Example 19 was prepared.

Example 20

The procedure for preparation of the recording medium in Example 16 was repeated except that 3-dibutylamino-6-methyl-7-anilinofluoran in liquid K was replaced with 20 parts of 3-(N-ethyl-p-toluidino)-7-anilinofluoran.

Thus a thermosensitive recording medium of Example 20 was prepared.

Example 21

The procedure for preparation of the recording medium in Example 16 was repeated except that 3-dibutylamino-6-methyl-7-anilinofluoran in liquid K was replaced with 20 parts of 3-diethylamino-6-ethyl-7-(3-methylanilino)fluoran.

Thus a thermosensitive recording medium of Example 21 was prepared.

Example 22

The procedure for preparation of the recording medium in Example 16 was repeated except that 3-dibutylamino-6-methyl-7-anilinofluoran in liquid K was replaced with 20 parts of 3-(N-methyl-N-cyclohexylamino)-6-methyl-7-anilinofluoran.

Thus a thermosensitive recording medium of Example 22 was prepared.

Example 23

The following components were mixed and dispersed using a sand mill to prepare a liquid S.

| Formulation of liquid S | |
|---|---|
| Tetrakis (2,2,6,6-tetramethyl-4-piperidyl)-1,2,3,4-butanetetracarboxylate | 20 |
| 10% polyvinyl alcohol aqueous solution | 20 |
| Water | 60 |

The procedure for preparation of the recording medium in Example 15 was repeated except that 3 parts of liquid S was added to the recording layer coating liquid.

Thus, a thermosensitive recording medium of Example 23 was prepared.

Comparative Example 9

The procedure for preparation of the recording medium in Example 15 was repeated except that 4-acetylbiphenyl in liquid M was removed from liquid M.

Thus, a thermosensitive recording medium of Comparative Example 9 was prepared.

Comparative Example 10

The procedure for preparation of the recording medium in Example 15 was repeated except that 4-acetylbiphenyl in liquid M was replaced with 20 parts of bis(p-methylbenzyl) oxalate.

Thus, a thermosensitive recording medium of Comparative Example 10 was prepared.

Comparative Example 11

The procedure for preparation of the recording medium in Example 15 was repeated except that 4-acetylbiphenyl in liquid M was replaced with 20 parts of diphenylsulfone.

Thus, a thermosensitive recording medium of Comparative Example 11 was prepared.

The thus prepared thermosensitive recording media of Examples 13 to 23 and Comparative Examples 9 to 11 were subjected to a printing test using a printing simulator manufactured by Ohkura Electric Co., Ltd. The printing conditions are as follows:

Printing energy: 0.45 W×0.60, 0.80, 1.00 or 1.20 ms (4 energy levels)

The recorded images were evaluated as follows:

(1) Image Density (ID) and Background Density (GD)

The image densities and background densities of the recorded images were measured by a reflection densitometer, Macbeth RD-914.

In addition, a heat block of 150° C. was contacted with each of the recording media for 1 second upon application of pressure of 2 kgf/cm$^2$.

(2) Preservability (Heat Resistance)

The images recorded by the heat block were preserved for 24 hours at 80° C.

The image densities and background densities of the preserved images were measured by a reflection densitometer, Macbeth RD-914.

(3) Resistance to Plasticizer

Three sheets of a polyvinyl chloride film (tradenamed as POLYMALAP 300 and manufactured by Shin-Etsu Polymer Co., Ltd.) were overlaid on each of the images (i.e., colored areas) recorded by the heat block, and then the images with polyvinyl chloride films were preserved for 24 hours at 40° C. under a pressure of 50 g/cm$^2$. After the test, the image densities and background densities of the preserved images were measured by a reflection densitometer, Macbeth RD-914.

The results are shown in Tables 3-1 and 3-2.

TABLE 3-1

| | Initial image qualities (printed by simulator) | | | | | Images recorded by heat |
|---|---|---|---|---|---|---|
| | ID (at 0.6 ms) | ID (at 0.8 ms) | ID (at 1.0 ms) | ID (at 1.2 ms) | GD | block ID |
| Ex. 13 | 0.36 | 0.92 | 1.08 | 1.23 | 0.08 | 1.29 |
| Ex. 14 | 0.45 | 0.90 | 1.08 | 1.22 | 0.08 | 1.28 |
| Ex. 15 | 0.55 | 1.06 | 1.21 | 1.22 | 0.08 | 1.29 |
| Ex. 16 | 0.57 | 1.08 | 1.21 | 1.22 | 0.06 | 1.30 |
| Ex. 17 | 1.13 | 1.18 | 1.20 | 1.23 | 0.05 | 1.31 |
| Ex. 18 | 0.57 | 1.08 | 1.23 | 1.22 | 0.05 | 1.29 |
| Ex. 19 | 0.51 | 1.03 | 1.21 | 1.21 | 0.06 | 1.28 |
| Ex. 20 | 0.50 | 1.01 | 1.19 | 1.24 | 0.06 | 1.27 |
| Ex. 21 | 0.49 | 1.02 | 1.25 | 1.27 | 0.06 | 1.35 |
| Ex. 22 | 0.48 | 1.00 | 1.21 | 1.24 | 0.06 | 1.30 |
| Ex. 23 | 0.59 | 1.09 | 1.24 | 1.25 | 0.05 | 1.31 |
| Comp. Ex. 9 | 0.35 | 0.86 | 1.04 | 1.06 | 0.08 | 1.08 |
| Comp. Ex. 10 | 0.38 | 0.96 | 1.12 | 1.13 | 0.08 | 1.05 |
| Comp. Ex. 11 | 0.27 | 0.71 | 1.06 | 1.15 | 0.08 | 1.14 |

TABLE 3-2

| | After heat resistance test | | After plasticizer resistance test | |
|---|---|---|---|---|
| | GD | ID | GD | ID |
| Ex. 13 | 0.08 | 1.28 | 0.08 | 1.29 |
| Ex. 14 | 0.08 | 1.29 | 0.08 | 1.29 |
| Ex. 15 | 0.08 | 1.30 | 0.08 | 1.28 |
| Ex. 16 | 0.07 | 1.29 | 0.06 | 1.28 |
| Ex. 17 | 0.06 | 1.35 | 0.06 | 1.27 |
| Ex. 18 | 0.06 | 1.31 | 0.06 | 1.25 |
| Ex. 19 | 0.07 | 1.30 | 0.08 | 1.28 |
| Ex. 20 | 0.06 | 1.29 | 0.06 | 1.27 |
| Ex. 21 | 0.08 | 1.35 | 0.08 | 1.33 |
| Ex. 22 | 0.07 | 1.31 | 0.07 | 1.29 |
| Ex. 23 | 0.06 | 1.30 | 0.06 | 1.29 |
| Comp. Ex. 9 | 0.08 | 1.09 | 0.08 | 1.06 |
| Comp. Ex. 10 | 0.08 | 1.05 | 0.08 | 1.02 |
| Comp. Ex. 11 | 0.08 | 1.11 | 0.08 | 1.06 |

As can be understood from Tables 1 to 3-2, by using a compound selected from the group consisting of the compounds having formulae (1) to (3), methylenebis(2-naphthol) and 4-hydroxybenzoate derivatives, as a color developer and using 4-acetylbiphenyl as a sensitizer, the resultant thermosensitive recording media have so good heat resistance as to be used for POS labels for foods, boxed lunches, dairy dishes, etc., which are typically heated at a high temperature when the goods are sold. In addition, the thermosensitive recording media have high sensitivity, and therefore the recording medium of the present invention has a practical use.

Additional modifications and variations of the present invention are possible in light of the above teachings. It is therefore to be understood that within the scope of the appended claims the invention may be practiced other than as specifically described herein.

This document claims priority and contains subject matter related to Japanese Patent Applications Nos. 2000-161731, 2000-172416 and 2000-237440, filed on May 31, 2000, Jun. 8, 2000 and Aug. 4, 2000, respectively, the entire contents of which are herein incorporated by reference.

What is claimed is:

1. A thermosensitive recording medium comprising;

a support; and a thermosensitive recording layer formed overlying the support and comprising a leuco dye, a color developer and a sensitizer, wherein the color developer comprises a compound selected from the group consisting of compounds having one of the following formulae (1), (2) and (3):

(1)

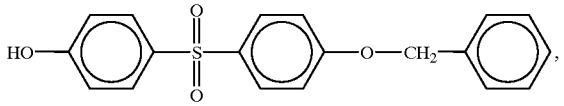

(2)

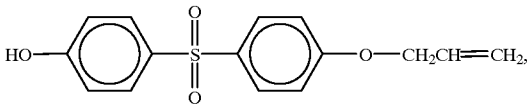

and (3)

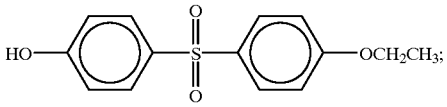

methylenebis(2-naphthol); and condensation products of a polyhydric alcohol component comprising a polyhydric alcohol having three or more hydroxyl groups with a carboxylic acid component comprising a 4-hydroxybenzoic acid compound having the following formula (4):

(4)

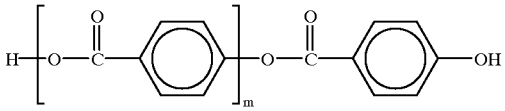

wherein m is 0 or an integer of from 1 to 2, and wherein the sensitizer comprises 4-acetylbiphenyl.

2. The thermosensitive recording medium according to claim 1, further comprising an undercoat layer between the support and the thermosensitive recording layer, wherein the undercoat layer comprises hollow particles having a hollow rate not less than 30% and a volume average particle diameter of from 0.4 to 10 $\mu$m.

3. A thermosensitive recording medium comprising;

a support; and a thermosensitive recording layer formed overlying the support and comprising a leuco dye, a color developer and a sensitizer, wherein the color developer comprises a compound selected from the group consisting of compounds having one of the following formulae (1), (2) and (3):

(1)

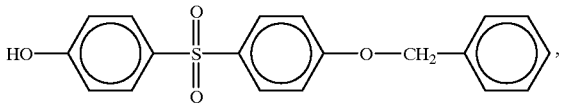

(2)

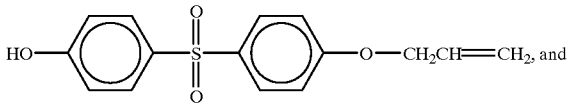

-continued (3)

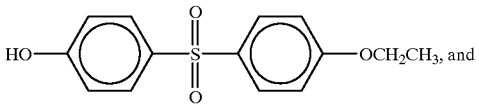

wherein the sensitizer comprises 4-acetylbiphenyl.

4. The thermosensitive recording medium according to claim 3, wherein a weight ratio of the color developer to 4-acetylbiphenyl is from 3/7 to 9/1.

5. The thermosensitive recording medium according to claim 3, further comprising an undercoat layer between the support and the thermosensitive recording layer, wherein the undercoat layer comprises hollow particles having a hollow rate not less than 30% and a volume average particle diameter of from 0.4 to 10 $\mu$m.

6. A thermosensitive recording medium comprising;

a support; and a thermosensitive recording layer formed overlying the support and comprising a leuco dye, a color developer and a sensitizer, wherein the color developer comprises methylenebis(2-naphthol), and wherein the sensitizer comprises 4-acetylbiphenyl.

7. The thermosensitive recording medium according to claim 6, wherein the leuco dye comprises 3-diethylamino-6-ethyl-7-(3-methylanilino)fluoran.

8. The thermosensitive recording medium according to claim 6, wherein the thermosensitive recording layer further comprises a compound having the following formula (5):

(5)

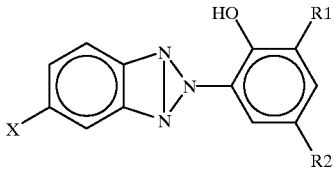

wherein R1 and R2 independently represent a hydrogen atom or an alkyl group having from 1 to 8 carbon atoms except that R1 and R2 are not both a hydrogen atom; and X represents a hydrogen atom or a chlorine atom.

9. The thermosensitive recording medium according to claim 8, wherein the compound having formula (5) is present in the thermosensitive layer in an amount of from 30 to 300 parts by weight per 100 parts by weight of the leuco dye.

10. The thermosensitive recording medium according to claim 6, further comprising a protective layer overlying the thermosensitive layer, wherein the protective layer comprises a compound having the following formula (5):

(5)

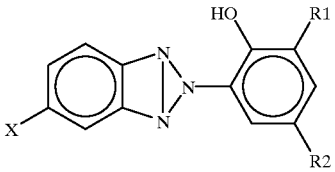

wherein R1 and R2 independently represent a hydrogen atom or an alkyl group having from 1 to 8 carbon atoms except that R1 and R2 are not both a hydrogen atom; and X represents a hydrogen atom or a chlorine atom.

11. The thermosensitive recording medium according to claim 10, wherein the compound having formula (5) is present in the protective layer in an amount of from 2 to 30% by weight based on total solid components in the protective layer.

12. The thermosensitive recording medium according to claim 6, further comprising an undercoat layer between the support and the thermosensitive recording layer, wherein the undercoat layer comprises hollow particles having a hollow rate not less than 30% and a volume average particle diameter of from 0.4 to 10 $\mu$m.

13. A thermosensitive recording medium comprising;

a support; and a thermosensitive recording layer formed overlying the support and comprising a leuco dye, a color developer and a sensitizer, wherein the color developer comprises a condensation product of a polyhydric alcohol component comprising a polyhydric alcohol having three or more hydroxyl groups with a carboxylic acid component comprising a 4-hydroxybenzoic acid compound having the following formula (4):

(4)

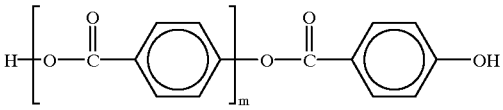

wherein m is 0 or an integer of from 1 to 2, and wherein the sensitizer comprises 4-acetylbiphenyl.

14. The thermosensitive recording medium according to claim 13, wherein the carboxylic acid component further comprises at least one of a monobasic carboxylic acid and a dibasic carboxylic acid, and the polyhydric alcohol component further comprises a dihydric alcohol.

15. The thermosensitive recording medium according to claim 13, wherein the polyhydric alcohol is a compound having the following formula (6):

(6)

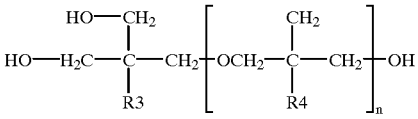

(6)

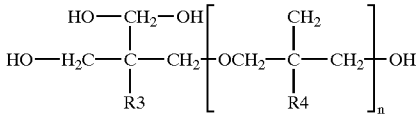

wherein n is 0 or an integer of from 1 to 9; R3 represents a hydroxymethyl group or an alkyl group having 1 to 8 carbon atoms; and each R4 independently represents a hydroxymethyl group or an alkyl group having 1 to 8 carbon atoms.

16. The thermosensitive recording medium according to claim 13, wherein the thermosensitive recording layer further comprises at least one of tetrakis(1,2,2,6,6-pentamethyl-4-piperidyl)-1,2,3,4-butanetetracarboxylate and tetrakis(2,2,6,6-tetramethyl-4-piperidyl)-1,2,3,4-butanetetracarboxylate.

17. The thermosensitive recording medium according to claim 13, further comprising an undercoat layer between the support and the thermosensitive recording layer, wherein the undercoat layer comprises hollow particles having a hollow rate not less than 30% and a volume average particle diameter of from 0.4 to 10 $\mu$m.

* * * * *